United States Patent [19]

Kreider et al.

[11] 4,008,691

[45] Feb. 22, 1977

[54] SUPPORT SYSTEM

[75] Inventors: Edward Wells Kreider, Wadsworth; Thomas Paul Hoosic, Clinton, both of Ohio

[73] Assignee: The Babcock & Wilcox Company, New York, N.Y.

[22] Filed: Mar. 30, 1976

[21] Appl. No.: 671,858

[52] U.S. Cl. ..... 122/494; 122/510

[51] Int. Cl.[2] ..... F22B 37/36; F22B 37/24

[58] Field of Search ..... 122/6 A, 494, 510; 110/56

[56] References Cited

UNITED STATES PATENTS

| | | | |
|---|---|---|---|
| 2,654,352 | 10/1953 | Schoenfeld | 122/494 |
| 3,277,870 | 10/1966 | Reale | 122/510 |
| 3,357,408 | 12/1967 | Patterson | 122/510 |
| 3,364,905 | 1/1968 | Jordan | 122/494 |
| 3,479,994 | 11/1969 | Kreider et al. | 122/494 |

*Primary Examiner*—Kenneth W. Sprague
*Attorney, Agent, or Firm*—J. Maguire; R. J. Edwards

[57] ABSTRACT

An arrangement for protecting the wall of a vapor generator from stresses due to thermal expansion of duct end sections and plenums associated therewith, and including support plate means which abut the plenum ends and transmit the stresses to rigid support members to be balanced by similar stresses from the opposite end of the plenum.

4 Claims, 5 Drawing Figures

FIG. 1
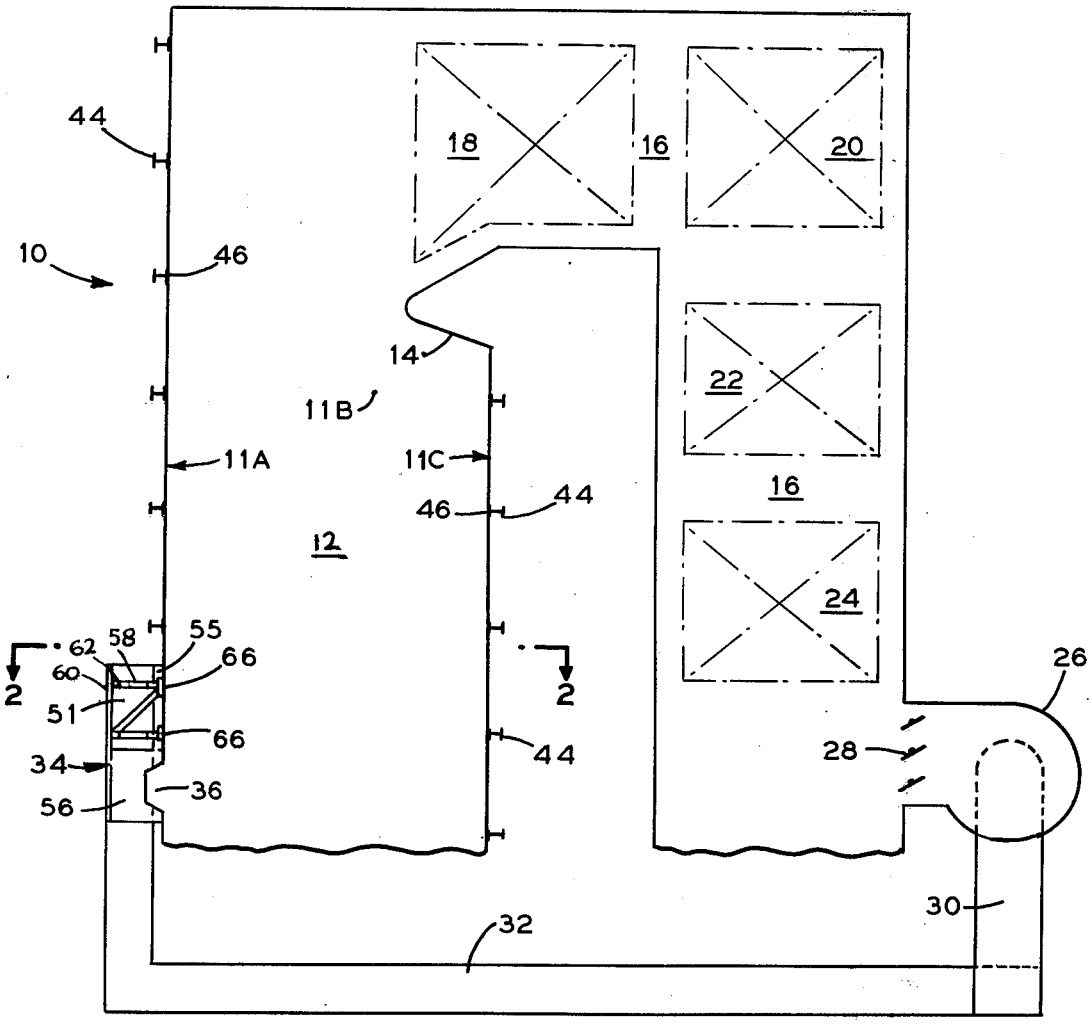
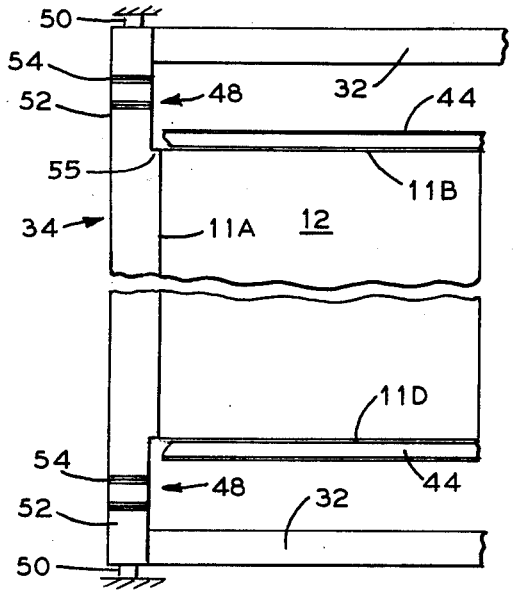
FIG. 2

SUPPORT SYSTEM

BACKGROUND OF THE INVENTION

The invention relates to vapor generator wall-supported gas plenums and more particularly to an arrangement for protecting the wall from stresses resulting from thermal expansion of the plenum and duct sections associated therewith.

The modern central station vapor generator includes a furnace or combustion chamber defined by upright walls commonly known as membrane walls and formed of upwardly extending laterally spaced fluid conducting tubes rigidly united by metallic webs throughout substantially all of their length. The burners and windboxes or air plenums are located along the lower portion of the furnace to deliver the fuel and air required to generate the combustion gases which heat the fluid being conducted through the wall tubes. A regulated quantity of combustion gases is recirculated to the furnace via gas tempering and/or recirculating plenums to minimize slag deposition and control vapor temperature.

The plenums are box-like enclosures and are outwardly mounted on the furnace wall. A duct is connected to opposite ends of each plenum to supply combustion air or recirculated gases therethrough to the furnace. The discharge portions of the ducts are connected to fixed supports and include end sections extending from the support to the plenum connections. Each of the end sections is normally provided with a pair of spaced and outwardly corrugated expansion joints which are intended to accommodate the movement due to thermal expansion of the plenum and duct end sections.

A problem has arisen with the prior art construction when applied to membrane walls, these have been known to buckle and tear as a result of stresses generated by the expansion movement of the ducts and plenum while overcoming the initial resistance of the corrugated joints. A further problem has been encountered as a result of stress buildup due to the eventual malfunction of duct floor related expansion joints caused by deposition of particulates in the corrugation groove

SUMMARY OF THE INVENTION

The present invention protects the membrane wall from stresses resulting from the expansion of the plenum and associated duct end sections by transmitting such stresses to adjoining tie bars wherein they are substantially balanced by similar stresses from the opposite end of the plenum.

In accordance with the invention, there is provided an arrangement whereby support plate means abut an offset in the plenum end walls adjacent the junction of the plenum and associated duct end sections to transmit expansion stresses from the offset to adjoining tie bars. Each support plate means is welded to a paddle-like extension of the tie bar and includes a toe plate abutting the plenum end wall offset, a pair of rib plates welded to the toe plate and a reinforcing plate extending from between the rib plates and along the tie bar extension.

BRIEF DESCRIPTION OF THE DRAWINGS

FIG. 1 is a schematic sectional elevation view of the upper portion of a vapor generator embodying the invention.

FIG. 2 is a plan view taken along line 2-2 of FIG. 1.

DESCRIPTION OF THE PREFERRED EMBODIMENTS

Figure 3:
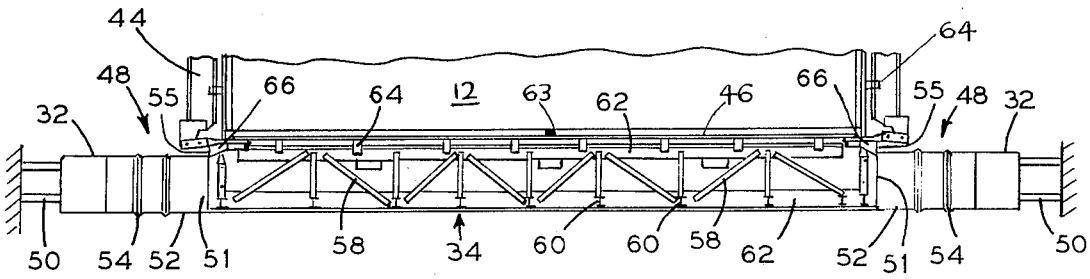
FIG. 3 is a sectional plan view of the gas recirculation plenum and associated duct end sections embodying the invention.

Referring to the drawings, there is shown the upper portion of a vapor generator 10 including membrane type walls 11A-D which define a furnace or combustion chamber 12 fired by a plurality of burners, not shown, to which fuel is fed in response to load demand. The products of combustion leaving the furnace 12 are commonly referred to as flue gas, and flow upwardly around the nose section 14, and thence through the convection gas pas 16 containing the secondary superheater 18, the reheater 20, the primary superheater 22 and the economizer 24.

The steam temperture leaving the secondary superheater 18 and particularly that leaving the reheater 20 is wholly or in part controlled by altering the heat absorption pattern within the vapor generator 10 through the introduction of a regulated quantity of flue gas into the furnace 12, which gas is withdrawn from a point downstream gas flow-wise of the economizer 24 by a gas recirculation fan 26. A damper 28 is associated with the fan 26 to regulate the quantity of flue gas being conveyed through a main duct 30 and thence through a pair of branch ducts 32 to opposite ends of a gas recirculation plenum 34 for introduction into the furnace 12 via openings 36 which are spaced along the width of the front wall 11A near the bottom of plenum 34.

The membrane walls 11 A-D lining the furnace 12 are formed of upwardly extending laterally spaced fluid conducting tubes 40 rigidly united by metallic webs 42 throughout substantially all of their length. An external support arrangement is provided for the walls 11 A-D and comprises a framework disposed in surrounding relation to the furnace 12, and which includes a plurality of vertically spaced buckstays 44 that are linked to the walls 11 A-D through rigid tie bars 46, the latter being weldably connected to the adjoinning wall midway along the width thereof. The connection between each tie bar 46 and its associated buckstay 44 is effected at spaced locations along their length by means of clips 64 which permit movement of the buckstay 44 while restraining its movement in a direction perpendicular to the associated wall 11A.

The discharge portions 48 of branch ducts 32 are supported from rigid structures 50 and include end sections 52 that are provided with pairs of spaced and outwardly corrugated expansion joints 54 which are intended to accomodate the movement due to thermal expansion of the plenum 34 and the duct end sections 52. The branch ducts 32 communicate with plenum 34 through the openings 51 which are located along an upper portion of the plenum end walls 56 and are offset from the furnace side of the plenum 34. A plurality of cross members 58 and vertical and horizontal beams 60 and 62 are interconnected to form a support grid for the plenum 34. The furnace side beam 62 is slidably connected to an adjoining tie bar 46 by means of clips 64 to permit endwise movement of the beam 62 while restraining its movement in a direction perpendicular to the associated wall.

When the vapor generator 10 is placed into operation and is gradually heated, the duct ends 52 and the gas recirculation plenum 34 undergo thermal expansion in the direction of the corrugated joints 54. The present invention is directed at an arrangement that protects the membrane wall 11A situated adjacent the plenum 34 from stresses due to initial resistance or malfunction of the corrugated expansion joints 54. The arrangement comprises support plate means 66 which are welded to adjoining tie bars 46 and abut the offset 55 of plenum end wall 56 next to the openings 51 to transmit the stresses to tie bars 46. The stresses thus transmitted to the tie bars 46 are balanced by similar stresses from the opposite end of plenum 34. Any unbalance of stresses would be relatively small and is transmitted through the welded connection 63 between the tie bars 46 and the associated wall 11A midway along the wall 11A.

Figure 4:
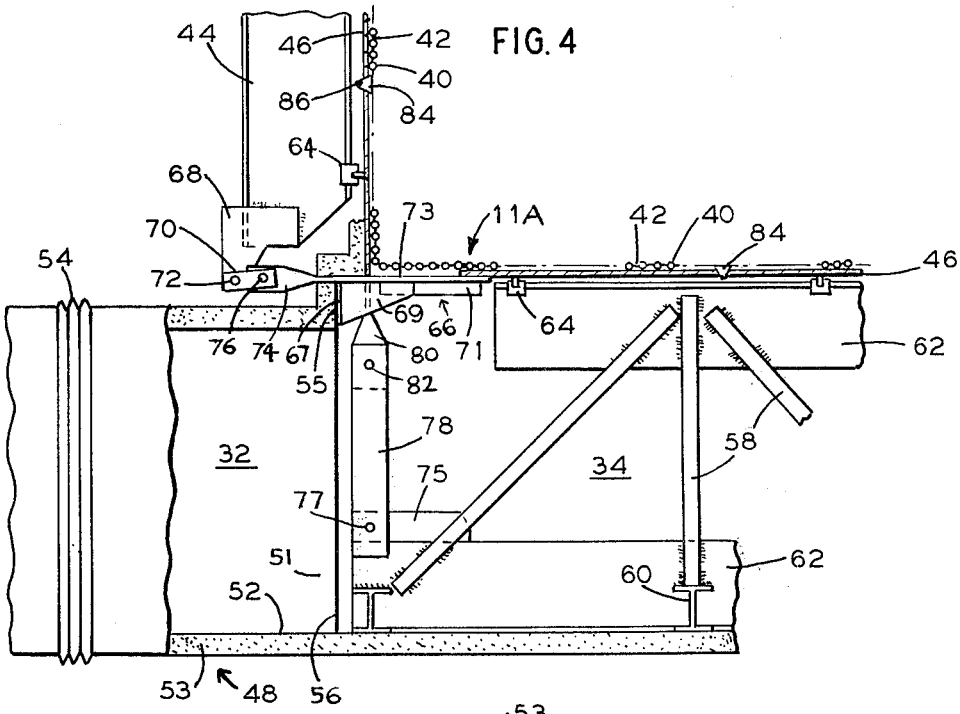
FIG. 4 is an enlarged view of one end of the plenum and associated duct end section embodying the invention.
Figure 5:
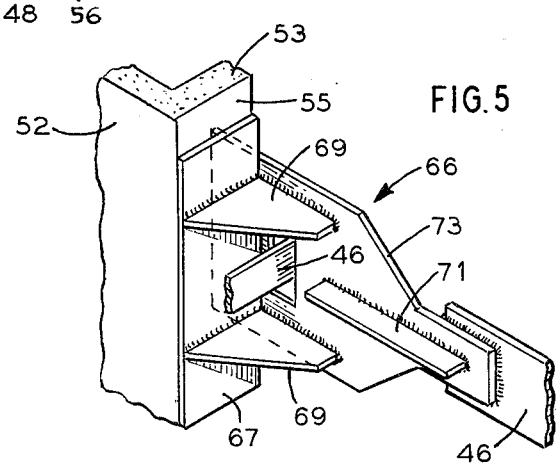
FIG. 5 is an enlarged perspective view of the support plate arrangement embodying the invention.

Referring specifically to FIGS. 4 and 5, there is also shown a plate 68 connected to the buckstay 44 and projecting beyond the end thereof and to which a link 70 is pivotally connected to the tie bar corner bracket 74 by a pin 76 in order to allow for expansion of the wall 11A and associated tie bar 46 relative to the buckstay 44. A somewhat similar arrangement is provided with respect to the outer horizontal beam 62 which has a link 78 connected to an offset 75 of beam 62 by a pin 77. The link 78 is also pivotally connected to the tie bar corner bracket 80 by a pin 82. In addition to each tie bar 46 being welded to the wall 11 midway along the width thereof, there are lugs 84 spaced along the wall and engaging the tie bar 46 through retaining pins 86 which permit endwise movement of the tie bar 46 while restraining its movement in a direction perpendicular to the associated wall 11 A-D. Corrugated expansion joints such as that shown at 54 are provided to accommodate the movement due to thermal expansion of metal casing of plenum 34 and duct end section 52, the metal casing being covered by insulation 53. In accordance with the invention, stresses due to initial resistance or malfunction of the corrugated expansion joints 54, are transmitted from the end wall offset 55 to adjoining tie bars 46 through associated support plate arrangements 66, each of which comprises a toe plate 67 abutting the wall offset 55, a pair of vertically spaced rib plates 69 welded to the open face of plate 67, and a reinforcing plate 71 extending from between the rib plates 69 to a point beyond the end thereof. The toe, rib and reinforcing plates 67, 69 and 71 are welded to a paddle-like extension 73 of the tie bar 46. The tie bar extension 73 is suitably slotted to accommodate the passing therethrough of a tie bar 46 associated with the side wall 11B of the furnace 12.

While in accordance with the provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

The embodiments of the invention in which an exclusive property or privilege is claimed are defined as follows:

1. In a fluid heating unit having upright walls defining a chamber therebetween for the flow of heating gases, structural members disposed outside the chamber and connected to said walls for lateral support and reinforcement thereof, at least one plenum extending along the width of one of the walls and communicating with said chamber, the plenum being attached to said wall, ducts supplying heated gases to opposite ends of the plenum, said ducts being connected to fixed supports and including end sections extending from the supports for connection to said plenum ends, plate means abutting the plenum ends and being rigidly connected to adjoining structural members to transmit end section and plenum thermal expansion stresses thereto.

2. The fluid heating unit according to claim 1 including the plate means being disposed within said plenum.

3. The fluid heating unit according to claim 1 including the plate means being disposed adjacent the junction of said ducts and plenum.

4. The fluid heating unit according to claim 1 including oppositely disposed plate means being rigidly connected to a common structural member.

* * * * *

UNITED STATES PATENT AND TRADEMARK OFFICE

CERTIFICATE OF CORRECTION

PATENT NO. : 4,008,691

DATED : February 22, 1977

INVENTOR(S) : Edward W. Kreider et al

It is certified that error appears in the above-identified patent and that said Letters Patent are hereby corrected as shown below:

Column 2, line 47, "adjoinning" should read --adjoining--.

Column 2, line 58, "accomodate" should read -- accommodate--.

Column 3, line 24, after the word connected and before the word to the following should be inserted: --by a pin 72. The link 70 is also pivotally connected--.

Column 3, lines 39-40, after the word of and before the word metal insert the word --the--.

Signed and Sealed this

*Twelfth* Day of *February 1980*

[SEAL]

*Attest:*

SIDNEY A. DIAMOND

*Attesting Officer*

*Commissioner of Patents and Trademarks*